United States Patent [19]

Smith et al.

[11] Patent Number: 5,017,249

[45] **Date of Patent: * May 21, 1991**

[54] NICKEL-BASE ALLOY

[75] Inventors: Gaylord D. Smith; Curtis S. Tassen; Pasupathy Ganesan, all of Huntington; Jack M. Wheeler, Lesage, all of W. Va.

[73] Assignee: Inco Alloys International, Inc., Huntington, W. Va.

[ * ] Notice: The portion of the term of this patent subsequent to Oct. 31, 2006 has been disclaimed.

[21] Appl. No.: 377,675

[22] Filed: Jul. 10, 1989

Related U.S. Application Data

[63] Continuation-in-part of Ser. No. 242,732, Sep. 9, 1988, Pat. No. 4,877,461.

[51] Int. Cl.[5] ..... C22C 19/05

[52] U.S. Cl. ..... 148/410; 148/11.5 N; 148/12.7 N; 148/427; 148/428

[58] Field of Search ..... 148/410, 428, 427, 11.5 N, 148/12.7 N; 420/445, 446, 449, 450

[56] References Cited

U.S. PATENT DOCUMENTS 4,877,461 10/1989 Smith et al. ..... 148/410

*Primary Examiner*—R. Dean

*Attorney, Agent, or Firm*—Francis J. Mulligan, Jr.; Edward A. Steen; Blake T. Biederman

[57] ABSTRACT

A nickel-chromium alloy exhibiting enhanced stress rupture strength and grain size stability at elevated temperatures up to about 1260° (2300° F.) due to the affirmative formation of $M_6C$ carbide within the alloy. The alloy is especially useful for turbine and engine applications.

10 Claims, No Drawings

NICKEL-BASE ALLOY

This is a continuation-in-part of application Ser. No. 242,732 filed Sept. 9, 1988, now U.S. Pat. No. 4,877,461.

The subject invention is directed to nickel-chromium alloys, and more particularly to nickel-chromium-molybdenum-tungsten-cobalt alloys characterized by a special carbide morphological microstructure which imparts to the alloys enhanced grain size stability and stress-rupture strength at elevated temperatures.

BACKGROUND

As those skilled in the art of gas turbine engine technology are aware, since the 1950's era, the search has been continuous in the quest for new alloys capable of withstanding increasingly severe operating conditions, notable temperature and stress, brought about by advanced designs. This has been evident, for example, in respect to gas turbine engine components such as combustors, augmentors and thrusters. Alloys of this type must be fabricable since they are often produced in complex shapes. But what is required apart from fabricability is a combination of properties, including good stress rupture life at high temperatures, 1600°-2000° F. (871°-1093° C.), low cycle fatigue, ductility, grain size stability, high temperature corrosion resistance, and weldability.

In significant measure, alloys currently used for such applications are those of the solid-solution type in which there is substantial carbide strengthening but not much by way of precipitation hardening of, say, the $Ni_3$ (Al, Ti) type (commonly referred to as gamma prime hardening). In the latter type the gamma prime precipitate tends to go back into solution circa 1700°-1750° F. (927°-954° C.) and thus is not available to impart strength at higher temperatures. One of the most recognized and widely used solid-solution alloys is sold under the designation INCONEL alloy 617, an alloy nominally containing 22% Cr, 12.5% Co, 9% Mo, 1.2% Al, and 1.5% Fe with minor amounts of carbon, silicon, and usually titanium. (INCONEL is a registered trademark of the INCO family of companies.) This alloy satisfies ASME Code cases 1956 [Sections 1 and 8 non-nuclear construction of plate, pipe and tube to 1650° F. (899°C.)] and 1982 [Section 8 non-nuclear construction of pipe and tube to 1800° F. (982° C.)].

Notwithstanding the many attributes of alloy 617, as currently produced, it has a stress rupture life of less than 30 hours, usually about 20 to 25 hours, under a stress of 9 psi (62.1 MPa) and at a temperature of 1700° F. (927°C.). What is required is a stress-rupture life level above 30 hours under such conditions. This would permit an opportunity (a) to reduce weight at constant temperature, or (b) increase temperature at constant weight, or (c) both. In all cases gas turbine efficiency would be enhanced, provided other above mentioned properties were not adversely affected to any appreciable extent.

Perhaps a conventional approach might suggest increasing the grain size of an alloy such as 617 since the larger grain sizes, ASTM #2 (0.007 inches (0.18 mm) average grain diameter) or larger, enhances stress-rupture strength. However, for gas turbine sheet applications, there are specifications which require about 4 to 10 grains across a thin gauge component to ensure satisfactory ductility and adequate low cycle fatigue. This in turn would mean that the average grain size should not be much beyond ASTM #4 (0.0035 inches (0.09 mm) average grain diameter) and preferably smaller in grain size. The requirement to retain small grain size is thwarted by conventional fabrication practices. The complex components of the combustor, augmentor and thruster of current engines are typically brazed using a brazing cycle of 2175° F. (1191° C.) for 20 minutes in vacuum or controlled atmosphere. At times, multiple brazing cycles are required. Alloy 617 under these conditions can easily grow the grain size from ASTM #4 to ASTM #0 (0.014 inches (0.36 mm) average grain diameter) or larger. The effect of this dramatic increase in grain size is to reduced low cycle fatigue life. Since fatigue is a common failure mechanism of gas turbine components, this increase in grain size is highly undesirable.

SUMMARY OF THE INVENTION

We have found that the stress-rupture strengthened grain size stability of a range of nickel-chromium-molybdenum-tungsten-cobalt alloys can be improved if the alloys are characterized by a special microstructure comprised predominantly of $M_6C$ carbides. It has been found that the $M_6C$, as will be discussed more fully infra, enhances stress-rupture strength and grain size stability to a greater extent than the $M_{23}C_6$ carbide. As will be apparent to those skilled in the art, the letter "M" in $M_6C$ denotes principally molybdenum and tungsten and to a lesser extend chromium. In $M_{23}C_6$, "M" represents principally the chromium atom and to a lesser extent the molybdenum, tungsten, iron and cobalt atom.

INVENTION EMBODIMENTS

Generally speaking and in accordance herewith, the contemplated nickel-chromium-molybdenum-tungsten-cobalt alloys contain about 18 to 25% chromium, about 0 to 12% molybdenum, about 0 to 15% tungsten, about 0 to 15% cobalt, about 0 to 8% iron, about 0.5 to 1.5% aluminum, up to about 0.5% titanium, about 0.04 to 0.15% carbon, up to about 0.04% nitrogen, up to about 0.02% boron, up to about 0.5% zirconium, about 0.05-0.75% silicon, and the balance is essentially nickel.

The sum of the iron plus cobalt should be no less than about 3% and no more than about 18%. A minimum of about 3% is considered essential to instigate uniform recrystallization of the alloy during annealing. Whereas, an iron plus cobalt content about 18% is considered detrimental to both phase stability and formation of $M_6C$ carbide. This is because iron and cobalt significantly favor the formation of $(Co, Fe)_7(Mo,W)_6$, commonly known as mu phase, at combined iron plus cobalt contents about about 18%. Mu phase formation would drastically reduce the amount of the solid solution strengtheners, molybdenum and tungsten, in solid solution. Further, excessive iron plus cobalt contents favor the formation of $M_{23}C_6$ carbides which deplete the matrix of chromium and carbon.

The sum of the molybdenum and tungsten content should be no less than about 10% and nor more than about 16%. A minimum of molybdenum plus tungsten of about 10% ensures a preference of $M_6C$ carbide formation by the alloy over $M_{23}C_6$and a minimum acceptable stress-rupture strength. Above about a sum of 16% molybdenum plus tungsten, the propensity for detrimental $(Co,Fe)_7$ $(Mo,W)_6$formation becomes excessive and the alloy can loose the effectiveness of a portion of its solid solution strengtheners. Chromium levels are maintained between about 18 and 25%. A minimum of about 18% chromium is necessary for oxidation and hot corrosion resistance. More than about 25% chromium favors the formation of $M_{23}C_6$ carbide.

The carbon content can vary from about 0.04 to 0.15%, but is preferably from about 0.065 to 0.12%. This range of carbon is essential to ensure about a 0.5 to 3.0% $M_6C$ carbide content. This range of $M_6C$ carbide is considered essential to maintain grain size stability during engine fabrication (brazing conditions) and ensure adequate stress-rupture strength. At carbon contents above about 0.15% excessive loss of molybdenum and tungsten from solid solution can result along with the potential embrittlement of the alloy through excessive carbide precipitation. The alloys of this invention tend to form $M_6C$ in preference to $M_{23}C_6$ when produced in according to the teaching of this invention. This is highly desirable because $M_6C$ is a much more thermally stable carbide than is $M_{23}C_6$ carbide. $M_{23}C_6$ carbide redissolves in the matrix at temperatures much above 1950° F. (1066°C.), whereas $M_6C$ carbides appear stable to about 2300° F. (1260°C.). Thus alloys of this invention possess superior grain size stability at temperatures to about 2300° F. (1260°C.) due to the predominant $M_6C$ carbide structure they possess.

About 0.05–0.75% silicon is added to promote oxidation resistance and the precipitation of $M_6C$ carbide. However, greater than about 0.75% silicon can unsatisfactorily reduce tensile and stress-rupture ductility of the alloy.

The alloy microstructure is essentially a solid solution in which there is a distribution of $M_6C$ carbides in both the grains and the grain boundaries. The $M_6C$ carbide should constitute about 0.5 to 3% by weight of the total alloy. No particular advantage is gained should this carbide exceed about 3%. In fact, stress rupture properties are lowered due to the loss of molybdenum and tungsten from solid solution strengthening. Further, it is preferred that the $M_6C$ carbide be not greater than about 3 microns in diameter, this for the purpose of contributing to creep and stress rupture life. Moreover, the alloy preferably about ASTM #4 (0.0035 inches (0.09 mm) average grain diameter), with the final grain size set by the degree of cold work, and the annealing temperature. Microstructurally the grains are highly twinned with the $M_6$ C particles being discrete and rather rounded.

In addition to the morphology described above, the alloy matrix will also contain a small volume fraction of titanium nitride (TiN) particles, up to approximately 0.20%, in the instance where the alloy contains titanium and nitrogen. The TiN phase can contribute somewhat to high temperature strength and grain size stabilization but not as importantly as $M_6C$ carbide. Gamma prime will normally be present in small quantities, usually less than 5%. If additional gamma prime strengthening is desired for moderate temperature applications, e.g., 1200°–1600° F. (649°–871°C.), the aluminum can be extended to 3% and the titanium to 5%.

In a most preferred embodiment, the alloy contains about 20 to 30% chromium, about 12 to 15% molybdenum plus tungsten, about 3 to 18% cobalt plus iron, about 0.8 to 1.5% aluminum, up to about 0.4% titanium, about 0.06 to 0.10 carbon, up to about 0.01% boron and the balance essentially nickel.

Referring again to alloy 617, since its inception (circa 15–20 years ago) it has been characterized by a microstructure predominantly of $M_{23}C_6$ carbides. A metallographic study was presented in 1974 by W. L. Mankins, J. C. Hosier and T. H. Bassford in a paper entitled "Microstructure and Phase Stability of INCONEL alloy 617", Metallurgical Transactions, Vol. 5, Dec. 1974, pages 2579–2589. The authors did not conclusively find $M_6C$ carbide but found a small volume fraction of gamma prime which imparted some degree of strength at 1200°–1400° F. (649°–760° C.). In a paper authored by Takahashi et al. entitled, "Analysis of Precipitated Phase in Heat Treated INCONEL Alloy 617", Transactions ISIJ, Vol. 18(1978), the authors concluded that while $M_{23}C_6$ carbide was the predominant phase, $M_6C$ carbide was present together with some gamma prime ($Ni_3Al$). As far as we are aware, there was no recognition in either study (nor since then) of the desirability of forming a predominant $M_6C$ carbide phase to enhance stress rupture strength and grain size stability.

In addition to the foregoing, we have also observed that a special combination of cold working and thermal processing of nickel-chromium-molybdenum-tungsten-cobalt alloys is most effective in producing the above discussed microstructure. In this regard, the alloys should be cold worked at least about 15% but not more than about 60% due to work hardening considerations. The amount of cold work can be extended down to 10% but at a needless sacrifice in properties. It is advantageous that the degree of cold work be from 15 to less than 6% and most preferably from 15 to 40%. Intermediate annealing treatments may be employed, if desired, but the last cold reduction step should preferably be at least about 15% of the original thickness.

Thermal processing operations should be conducted above the recrystallization temperature of the alloy, i.e., over the range of about 1950° to about 2300° F. (1066° to 1260° C.) for a period at least sufficient (i) to permit of an average grain size of about ASTM #4 (0.0035 inches (0.09 mm) average grain diameter) to form and (ii) to precipitate the $M_6C$ carbides. A lesser amount of $M_{23}C_6$ carbides may also form together with any TiN (the TiN is likely already present from the melting operation). Annealing conditions are time, temperature and section thickness dependent. For thin strip or sheet, say less than 0.025 inches in thickness, a temperature of about 1950° to 2300° F. (1066° to 1260° C.) the time may be as short as 1 or 2 minutes. The holding time need not exceed 20 minutes. For most wrought products, a holding period of up to about 15 or 20 minutes, say 3 to 5 minutes, is deemed satisfactory. Cold worked alloys exposed at temperatures much below 1950° (1066° C.) tend to form the $M_{23}C_6$ carbide. If treated much above 2300° F. (1260° C.), the carbides formed during prior processing and heat-up virtually all dissolve. As a consequent, upon subsequent exposure at temperatures below 1950° F. (1066° C.) only $M_{23}C_6$ carbides will tend to form. A more satisfactory annealing temperature is from about 2000° (1093° C.) to about 2300° F. (1260° C.) and a most preferred range is from about 2150° F. (1177° C.) to about 2250° F. (1232° C.).

In addition to the above, it might be added that the $M_6$ C and $M_{23}C_6$ carbides both vie and are competitive for the limited available carbon. The $M_6C$ carbide forms in appreciable amounts when $M_{23}C_6$ carbide has been resolutionized and $M_6C$ carbide is still thermodynamically stable, a condition which exists above about 1950° F. (1066° C.) and below about 2300° F. (1260° C.). Cold work is essential to trigger the desired microstructure. However, too much cold work can result in an excessive amount of precipitate with concomitant depletion of the solid solution strengtheners, molybdenum and tungsten.

To give those skilled in the art a better appreciation of the invention the following information and data are given.

Commercial size heats, 30 to 50 pounds (13.6 to 22.7 kg), were vacuum cast for this invention. Chemistries are given in Table I. Alloys A through K represent compositions within the scope of the invention. Compositions 1 through 4 are outside the scope of the invention and are presented to illustrate the consequences of exceeding the compositions limits of the invention.

TABLE I

| | Compositions of This Invention Weight Percent | | | | | | | | | | |
|---|---|---|---|---|---|---|---|---|---|---|---|
| Alloy | C | Mn | Fe | Si | Ni | Cr | Al | Ti | Co | Mo | W |
| A | 0.08 | 0.06 | 0.89 | 0.19 | 48.76 | 22.15 | 1.33 | 0.29 | 11.91 | 0.07 | 14.19 |
| B | 0.10 | 0.41 | 2.84 | 0.43 | 56.07 | 22.09 | 0.61 | 0.32 | 1.27 | 1.86 | 13.66 |
| C | 0.08 | 0.06 | 3.11 | 0.44 | 45.92 | 21.73 | 1.32 | 0.31 | 11.63 | 5.37 | 9.56 |
| D | 0.08 | 0.06 | 3.04 | 0.45 | 45.36 | 22.11 | 1.33 | 0.32 | 11.85 | 9.95 | 5.25 |
| E | 0.10 | 0.03 | 1.05 | 0.23 | 49.92 | 22.03 | 1.33 | 0.32 | 12.48 | 9.71 | 2.59 |
| F | 0.10* | 0.03 | 1.07 | 0.22 | 51.15 | 22.08 | 1.35 | 0.32 | 12.52 | 10.71 | 0.29 |
| G | 0.10* | 0.06 | 1.06 | 0.58 | 51.11 | 21.87 | 1.48 | 0.32 | 12.45 | 10.80 | 2.96 |
| H | 0.08 | 0.04 | 1.06 | 0.09 | 50.23 | 21.66 | 1.37 | 0.31 | 12.34 | 9.53 | 2.97 |
| I | 0.04 | 0.04 | 1.29 | 0.10 | 49.08 | 22.09 | 1.25 | 0.31 | 12.33 | 10.57 | 2.58 |
| J | 0.09 | 0.07 | 6.95 | 0.20 | 53.94 | 21.60 | 1.31 | 0.40 | 4.99 | 10.02 | — |
| K | 0.08 | 0.11 | 3.18 | 0.45 | 57.34 | 21.77 | 1.29 | 0.32 | 0.09 | 9.45 | 5.59 |
| 1 | 0.08 | 0.07 | 11.23 | 0.17 | 51.81 | 20.74 | 1.21 | 0.33 | 4.71 | 9.44 | — |
| 2 | 0.08 | 0.06 | 9.36 | 0.17 | 44.38 | 22.06 | 1.31 | 0.31 | 12.02 | 9.97 | — |
| 3 | 0.08 | 0.06 | 5.03 | 0.17 | 53.66 | 22.10 | 1.30 | 0.32 | 12.00 | 0.19 | 4.84 |
| 4 | 0.06 | 0.03 | 0.86 | 0.08 | 54.23 | 21.91 | 1.17 | 0.19 | 12.55 | 8.87 | — |

*Plus 0.03% Nitrogen

Ingots were hot worked at about 2150 to 2200° F. (1177° to 1204° C.) from 4 inches square (10.02 cm square) to about 0.3 inches (0.76 cm) thick flats. The alloys were then cold rolled to about 0.062 inches (0.16 cm) thick sheet with 2150° F. (1177° C.) anneals for 5 minutes at temperature and water quenched after cold reductions of about 40%.

Stress-rupture lives for the alloys of this invention are given in Table II. Unless noted, the specimens were annealed at 2200° F. (1204°C.) for 2-5 minutes at temperature and water quenched.

TABLE II

| Stress-Rupture Lives at 1700° F. (927° C.)/9 ksi (62.1 MPa) | | |
|---|---|---|
| Alloy | Time, Hour | Elongation, % |
| A | 37.5 | 34.3 |
| B | 31.3 | 65.6 |
| C | 36.7 | 44.8 |
| D | 37.1 | 34.2 |
| E*** | 13.5* | 45.0 |
| F*** | 15.0* | 31.0 |
| G**** | 15.4 | 65.0 |
| H**** | 29.4** | 33.4 |
| I**** | 30.7** | 54.0 |
| J | 36.2 | 30.7 |
| K | 29.3 | 65.4 |
| 1*** | 8.5* | 74.0 |
| 2*** | 9.0* | 60.8 |
| 3*** | 14.4 | 15.2 |
| 4***** | 15.0** | 55.0 |

*Stress-rupture condition is 1700° F. (927° C.) at 11 ksi (75.9 MPa)
**Stress-rupture condition is 1600° F. (871° C.) at 14.2 ksi (97.9 MPa)
***Annealed at 2175° F. (1191° C.)/2-5 minutes at temperature and water quenched
****Annealed at 2250° F. (1232° C.)/2-5 minutes at temperature and water quenched
*****Annealed at 2125° F. (1163° C.)/2-5 minutes at temperature and water quenched The grain size stability of the alloys of this invention is crucial to their practical application. The alloys must be capable of experiencing one to three brazing cycles at 2175° F. (1191° C.) for 20 minutes per cycle without increasing the average grain size much above about ASTM #4 (0.0035 inches (0.09 mm) average grain diameter) if at all. This grain size stability is necessary to assure a satisfactory low cycle fatigue life of gas turbine components. Table III depicts the grain size stability of the alloys of this invention [grain size is given in mils (0.001 inches) (0.03 mm)] at 2175° F. (1191° C.) for times of 30, 60 and 90 minutes and at 2200° F. (1204° C.) for 5 minutes. Also shown in Table III, are the grain sizes of alloys outside this invention. Clearly, alloys within the invention possess excellent grain size stability whereas alloys outside this invention experience unsatisfactory grain growth.

TABLE III

| Grain Size Stability Of The Alloys Of This Invention For Various Thermal Exposures Grain Size In Mils [(0.001 Inches (0.025 mm)] (mm) | | | | |
|---|---|---|---|---|
| | 2175° F. (1191° C.) | | | 2200° F. (1204° C.) |
| Alloy | 30 minutes | 60 minutes | 90 minutes | 5 minutes |
| A | 1.2 (0.030) | 1.8 (0.046) | 2.0 (0.051) | 1.2 (0.030) |
| B | 1.2 (0.030) | 1.8 (0.046) | 2.0 (0.051) | 0.9 (0.022) |
| C | 1.5 (0.038) | 1.8 (0.046) | 2.0 (0.051) | 0.9 (0.022) |
| D | 2.0 (0.051) | 2.5 (0.063) | 3.0 (0.076) | 3.5 (0.088) |
| E | 1.5 (0.038) | 1.8 (0.046) | 2.0 (0.051) | 2.0 (0.051) |
| F | 2.0 (0.051) | 2.0 (0.051) | 2.0 (0.051) | 2.5 (0.063) |
| G | 1.8 (0.046) | — | — | 2.0 (0.051) |
| H | 1.8 (0.046) | — | — | 2.5 (0.063) |
| I | 1.8 (0.046) | — | — | 1.8 (0.046) |
| J | 2.5 (0.063) | 3.0 (0.076) | 3.5 (0.088) | 3.5 (0.088) |
| K | 2.5 (0.063) | 3.0 (0.076) | 3.5 (0.088) | 3.0 (0.076) |
| 1 | 2.5 (0.063) | 3.5 (0.088) | 4.0 (0.10) | 7.0 (0.17) |
| 2 | 1.8 (0.046) | 2.5 (0.063) | 3.5 (0.088) | 5.0 (0.12) |
| 3 | 2.5 (0.063) | 3.5 (0.088) | 6.0 (0.15) | 7.0 (0.17) |
| 4 | 16.0 (0.40) | 22.0 (0.55) | 26.0 (0.66) | — |

Grain size stability of the alloys of this invention is attributed to the 0.5 to 3.0% $M_6C$ carbide which is formed in the alloy during annealing. Table IV presents the data on $M_6C$ carbide content of selected alloys of this invention. Comparing the grain size stability data of Table III with the percent $M_6C$ carbide of Table IV shows that within the 0.5 to 3.0% $M_6$carbide precipitate range, excellent grain size stability can be achieved at 2175° F. (1191° C.) for periods of times as long as 90 minutes. Further comparing the stress rupture life results of Table II with the percent $M_6C$ carbide data of Table IV, demonstrates that satisfactory stress-rupture lives can be achieved with the alloys of this invention containing 0.5 to 3.0% $M_6C$ carbide.

TABLE IV

| Alloy | $M_6$ Content Of Annealed Alloys Annealing Conditions Temperature, °F. (°C.)/2-5 Minutes/Water Quenched | $M_6C$ Content % |
|---|---|---|
| C | 2200 (1204) | 1.03 |
| D | 2200 (1204) | 0.53 |
| E | 2175 (1191) | 0.79 |
| H | 2250 (1232) | 2.05 |
| I | 2250 (1232) | 0.99 |
| K | 2200 (1204) | 2.77 |

Alloys 1 through 4 are outside the scope of this invention. Alloy 1 contains 11.23% iron and 4.71% cobalt (15.94% iron plus cobalt.) This alloy has poor grain size stability as shown in Table III and low stress-rupture life as compared to the alloys of this invention. See Tale II. These poor characteristics are attributed to the high iron content, i.e., greater than 8% iron, even though the sum of the iron plus cobalt is within the range of this invention. Alloy 2 contains 9. 3% iron and 12.02% cobalt (21.32% iron plus cobalt). The grain size stability and stress-rupture life results are similar to those of Alloy 1, confirming the 8% iron limit and the 18% limit for the sum of the iron plus cobalt. Both of these alloys are similar to the alloys of this invention in all other respects. Alloy 3 contains iron and cobalt levels within the scope of this invention but the molybdenum content is only 0.19% and the tungsten content is only 4.84% (5.03% molybdenum plus tungsten). This alloy has poor grain size stability (Table III) and low stress-rupture life (Table II) when contrasted with the alloys of this invention. Alloy 4 contains satisfactory levels of iron and cobalt but the sum of the molybdenum plus tungsten is only 8.89% (9.89% molybdenum, 0% tungsten). As shown in Tables II and III, this alloy has poor grain size stability and low stress rupture strength as compared to alloy H and I tested using the same stress-rupture test conditions.

Alloys of this invention, in addition to combustor, augmentor and thruster components are deemed useful as fuel injectors and other gas turbine engine components operating above 1500° F. (816° C.). For applications over the range of 1200°-1500° F. (649°-816° C.), the alloys are useful as shrouds, seal rings, bellows and exhaust ducting.

As contemplated herein, the term "balance" or "balance essentially" as used herein in reference to the nickel content does not exclude the presence of other elements which do not adversely affect the basic characteristics of the alloy. This includes oxidizing and cleansing elements in small amounts. For example, magnesium or calcium can be used as a deoxidant. It should not exceed 0.2% (retained). Elements such as sulfur and phosphorus should be held to as low percentages as possible, say, 0.015% maximum sulfur and 0.03% maximum phosphorus. While copper can be present it is preferable that it not exceed 1%. Niobium, while it can be present, tends to detract from cyclic oxidation resistance which is largely conferred by the co-presence of chromium and aluminum. Zirconium can beneficially be present up to 0.25%. Rare earth elements up to 0.15% may also be present to aid oxidation resistance at temperatures above 1800° F. (982° C.). The alloy range of one constituent of the alloy contemplated herein can be used with the alloy ranges of the other constituents.

While in accordance with the provisions of the statute, there is illustrated and described herein specific embodiments of the invention. Those skilled in the art will understand that changes may be made in the form of the invention covered by the claims and the certain features of the invention may sometimes be used to advantage without a corresponding use of the other features.

The embodiments of the invention in which an exclusive property or privilege is claimed are defined as follows:

1. A nickel-chromium alloy having enhanced stress rupture strength and grain size stability at elevated temperatures up to about 1260° C. (2300° F.), the alloy consisting essentially of about 18–25% chromium, up to about 12% molybdenum, up to about 15% tungsten, up to about 15% cobalt, up to about 8% iron, the summation of molybdenum and tungsten ranging between about 10–16%, the summation of cobalt and iron ranging between about 3–18%, up to about 3% aluminum, up to about 5titanium, about 0.04–0.15% carbon, up to about 0.04% nitrogen, up to about 0.02% boron, about 0.05–0.75% silicon, up to about 0.05% zirconium, the balance nickel and trace elements, the alloy further characterized by a substantially recrystallized equiaxed microstructure including about 0.5–3.0% $M_6C$ carbide, the $M_6C$ carbide generally less than about 3 microns in diameter.

2. The alloy according to claim 1 including about 20–23% chromium, the summation of molybdenum and tungsten from about 12–15%, about 0.8–1.5% aluminum, up to about 0.4% titanium, about 0.06–0.10% carbon, up to about 0.01% boron, the balance essentially nickel.

3. The alloy according to claim 1 including about 0.5–1.5% aluminum, and up to about 0.5% titanium.

4. The alloy according to claim 1 including about 0.065–0.12% carbon.

5. The alloy according to claim 1 including up to about 0.2% titanium nitride.

6. The alloy according to claim 1 wherein the alloy is cold worked about 15% to 60%.

7. The alloy according to claim 1 wherein the alloy is recrystallized at about 1066°–1260° C. (1950°–2300° F.) until the requisite morphology is achieved.

8. The alloy according to claim 7 wherein the alloy is recrystallized at about 1093°–1260° C. (2000°–2300°F.).

9. The alloy according to claim 7 whereas the alloy is recrystallized at about 1177°–1232° C. (2150°–2250° F.)

10. The alloy according to claim 1 including recrystallized equiaxed microstructure of about ASTM #4.

* * * * *